US010058180B2

(12) United States Patent
Desanta

(10) Patent No.: US 10,058,180 B2
(45) Date of Patent: Aug. 28, 2018

(54) CHAIR, IN PARTICULAR OFFICE CHAIR

(71) Applicant: Haworth GmbH, Ahlen (DE)

(72) Inventor: Simon Desanta, Borgholzhausen (DE)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 14/422,916

(22) PCT Filed: Aug. 16, 2013

(86) PCT No.: PCT/EP2013/067130

§ 371 (c)(1),
(2) Date: Feb. 20, 2015

(87) PCT Pub. No.: WO2014/029696

PCT Pub. Date: Feb. 27, 2014

(65) Prior Publication Data

US 2015/0245713 A1 Sep. 3, 2015

(30) Foreign Application Priority Data

Aug. 23, 2012 (DE) ..... 10 2012 107 778

(51) Int. Cl.
*A47C 3/025* (2006.01)
*A47C 3/026* (2006.01)
(Continued)

(52) U.S. Cl.
CPC ..... *A47C 1/03255* (2013.01); *A47C 1/032* (2013.01); *A47C 7/024* (2013.01);
(Continued)

(58) Field of Classification Search
CPC ..... A47C 1/032; A47C 1/03255; A47C 7/006; A47C 7/024; A47C 7/14; A47C 7/40; A47C 7/448
(Continued)

(56) References Cited

U.S. PATENT DOCUMENTS 3,512,831 A * 5/1970 Flint ..... A47C 7/14 297/285
4,641,885 A * 2/1987 Brauning ..... A47C 1/03277 297/292
(Continued)

OTHER PUBLICATIONS

International Search Report for International Application PCT/EP2013/067130, dated Nov. 7, 2013.
(Continued)

*Primary Examiner* — Rodney B White
(74) *Attorney, Agent, or Firm* — Warner Norcross + Judd LLP

(57) ABSTRACT

Chair, more especially an office chair, comprising a seat plate (34) which is arranged on an undercarriage (12) and a backrest (14) which in the manner of a so called synchronous mechanism permit a synchronous movement of seat plate (34) and backrest (14), characterized in that the seat plate (34) is mounted laterally tiltable and the backrest includes two backrest supports (22, 24) whose lower ends are mounted pivotally independently of each other on the undercarriage (12) and are coupled in movement to the seat plate (34) in such a manner that by rearward pivoting of the support (22, 24) one side of the seat plate (34) is pressed down on the same side and the opposite side thereof is raised.

10 Claims, 10 Drawing Sheets

(51) Int. Cl.

| | |
|---|---|
| ***A47C 1/032*** | (2006.01) |
| ***A47C 7/02*** | (2006.01) |
| ***A47C 7/14*** | (2006.01) |
| ***A47C 7/40*** | (2006.01) |
| ***A47C 7/44*** | (2006.01) |

(52) U.S. Cl.
CPC ..... *A47C 7/14* (2013.01); *A47C 7/40* (2013.01); *A47C 7/448* (2013.01)

(58) Field of Classification Search
USPC ..... 297/285, 292, 293, 296, 297, 314
See application file for complete search history.

(56) References Cited

U.S. PATENT DOCUMENTS 5,951,109 A * 9/1999 Roslund, Jr. ..... A47C 1/03255 297/299
6,761,406 B2 * 7/2004 Kinoshita ..... A47C 3/12 297/296
6,923,503 B2 * 8/2005 Sangiorgio ..... A47C 1/03255 297/300.3
7,004,543 B2 * 2/2006 Caruso ..... A47C 1/03 297/300.2
7,396,079 B2 * 7/2008 Heidmann ..... A47C 7/405 297/284.4
7,568,763 B2 * 8/2009 Bedford ..... A47C 1/023 297/285
7,637,570 B2 * 12/2009 Becker ..... A47C 7/28 297/314 X
7,712,833 B2 * 5/2010 Ueda ..... A47C 1/03255 297/296
7,802,847 B2 * 9/2010 Chou ..... A47C 1/026 297/285
7,862,120 B2 * 1/2011 Ueda ..... A47C 1/03255 297/285
8,029,060 B2 * 10/2011 Parker ..... A47C 1/023 297/300.1
8,272,691 B2 * 9/2012 Hsuan-Chin ..... A47C 7/402 297/285 X
8,567,864 B2 * 10/2013 Deisig ..... A47C 3/045 297/285
8,820,835 B2 * 9/2014 Minino ..... A47C 1/022 297/285
9,504,325 B2 * 11/2016 Sander ..... A47C 1/03255
2004/0195882 A1 10/2004 White
2005/0168030 A1 * 8/2005 Bykov ..... A47C 3/0252 297/312
2007/0108818 A1 * 5/2007 Ueda ..... F16F 1/22 297/285
2007/0108819 A1 * 5/2007 Ueda ..... A47C 7/443 297/292
2007/0108821 A1 * 5/2007 Ueda ..... A47C 1/03255 297/301.1
2007/0108822 A1 * 5/2007 Ueda ..... A47C 1/03255 297/301.6
2007/0108831 A1 * 5/2007 Ueda ..... A47C 1/03255 297/452.29
2008/0169693 A1 7/2008 Becker et al.
2009/0085388 A1 * 4/2009 Parker ..... A47C 1/023 297/311
2009/0261642 A1 * 10/2009 Dickie ..... A47C 7/446 297/314
2010/0259082 A1 * 10/2010 Votteler ..... A47C 1/03255 297/285
2010/0301652 A1 12/2010 Ballendat et al.
2012/0146377 A1 * 6/2012 Diffrient ..... A47C 1/03255 297/285
2012/0256458 A1 * 10/2012 Gehner ..... A47C 7/14 297/314
2013/0082499 A1 * 4/2013 Schmitz ..... A47C 1/03255 297/285
2017/0035201 A1 * 2/2017 Sander ..... A47C 1/02

OTHER PUBLICATIONS

Preliminary Report on Patentability for International Application PCT/EP2013/067130, dated Dec. 11, 2014.
Written Opinion from Examining Authority for International Application PCT/EP2013/067130, dated Sep. 23, 2014.
Written Opinion from the Search Authority for International Application PCT/EP2013/067130, dated Aug. 30, 2013.

* cited by examiner

CHAIR, IN PARTICULAR OFFICE CHAIR

BACKGROUND OF THE INVENTION

The invention relates to a chair, more especially an office chair, comprising a seat plate which is arranged on an undercarriage and a backrest which in the manner of a so called synchronous mechanism permit a synchronous movement of backrest and seat plate.

Such chairs are known in numerous constructional forms. They have a coordinated movement of backrest and seat plate. This means that when the user leans against the backrest the latter and the seat plate assume a position which corresponds substantially to a lying or leant back position. The result of such a synchronous movability is that when working the user can sit upright in a forwardly inclined position whereas in the leant back position he assumes a position of rest.

Such a movement coupling of seat plate and backrest is generally referred to as synchronous mechanism. Chairs which are equipped with such a mechanism have the advantage that they adjust themselves substantially automatically to the weight of the user without any manual adjustment being necessary. The cooperation of seat and backrest in the sense described takes place independently of the weight of the user.

The hitherto known chairs with synchronous mechanism already afford a relatively high sitting comfort. However, the hitherto known chair constructions cannot adjust themselves to load shifts from one side of the seat surface to the other or to forces acting on one side of the backrest. However, such unequal loads frequently occur in the use of office chairs. For ergonomic reasons it would be desirable to accommodate corresponding loads so that the chair can adapt itself to a laterally changed posture of the user. Known chairs however do not afford any such possibilities.

The problem underlying the present invention is therefore to provide a chair having a synchronous mechanism of the type mentioned at the beginning which can adapt itself to different loads on both sides of the chair and in this manner further increases the sitting comfort.

This problem is solved according to the invention by a chair having the features of claim 1.

The seat plate of the chair according to the invention is mounted laterally tiltable, i.e. it can be tilted about a longitudinal axis of the chair, said axis extending substantially forwardly from the backrest. This tilting can be combined with a tilting movement about a transverse axis of the chair in the sense of the hitherto known synchronous mechanism. The seat plate is coupled to two backrest supports whose lower ends are pivotally mounted on the undercarriage in such a manner that that they can be pivoted independently of each other and can assume different inclinations. By the movement coupling between the seat plate and the supports said seat plate is pressed down on the same side by a rearward pivoting of the support whilst the opposite side thereof is raised.

This movement coupling represents a considerable extension of the hitherto known principle of the synchronous mechanism and corresponds to a greater extent to an ergonomic sitting position because crosswise acting loads on the seat plate and the backrest can be compensated by the mechanism of the chair.

According to a preferred embodiment of the invention the lower ends of the backrest supports are connected pivotally about a common horizontal axis to a base of the undercarriage and the tilt axis for the lateral tilting of the seat plate lies in a vertical plane between the backrest supports. Said base can be a part at the upper end of the central column of the undercarriage which is mounted vertically adjustably on the column and is stationary with respect to the movability of the backrest and the seat plate.

According to a further preferred embodiment on both sides of the seat plate bearings are provided which receive the lower ends of the backrest supports in a region behind the pivot axis thereof. Said bearings can for instance engage round the lower ends of the supports laterally and from below, for example such that the support ends lie in the bearings on resilient pads. If one of the two backrest supports is pivoted rearwardly about its horizontal axis a pressure is exerted downwardly on the bearing assembly and presses the seat plate downwardly on the corresponding side. This leads to the desired lateral tilting of the seat plate.

Preferably the seat plate is pivotal together with the lower ends of the backrest supports about the horizontal pivot axis thereof. Thus, in this case the seat plate can be not only laterally tilted but can also execute a pivot movement about a transverse axis of the chair so that on uniform load on the two backrest supports it can tilt down rearwardly.

Further preferably, in the rear region of the undercarriage a bearing member is mounted which is tiltable about the pivot axis of the backrest supports and supports the pivot shaft of the seat plate. This bearing member if thus tilted together with the backrest supports and the seat plate about a transverse axis.

According to a further preferred embodiment of the present invention the seat plate is arranged in the rear region of the seat surface and in the front region of the seat surface a front seat plate is arranged, and from said seat plate on both sides of the chair leg springs extend rearwardly and support the rear tiltable seat plate from below on both sides. The rear seat plate can then execute the tilting movement only against the resistance of the leg springs which when no load is present keep the seat plate in a balanced position.

According to a further preferred embodiment of the present invention the front seat plate is carried by a front bearing member whose rear end is articulately connected to a front end of the bearing member and whose front end is articulately connected to the front end of the base of the undercarriage lying therebelow via a connection member which at its rear end receives the pivot shaft of the supports. The front bearing member, the bearing member arranged therebehind and connected articulately thereto for supporting the rear seat plate and the front connecting member are then connected to the base to form a quadrilateral whose corners are formed by articulations which permit the front bearing member, the rear bearing member and the connecting member to be adjusted with respect to each other so that they can form different angles to each other.

According to a further preferred embodiment of the invention the lower ends of the backrest supports are formed by legs angled forwardly in L shape, the front portions of which are connected pivotally about substantially vertically directed axes of rotation to the remainder of the respective support and the front ends of which accommodate the horizontal pivot shafts of the supports. Thus, in this case the backrest supports are not only pivotal with respect to the undercarriage about a common horizontal axis; in addition, the spacing of their vertical legs can be adjusted by a pivoting thereof with respect to the front portions of the horizontal legs mounted on the undercarriage.

More preferably the backrest supports are connected in an upper region by a transverse member whose ends are articulately connected to the supports in such a manner that the spacing between the connection points on the supports is kept constant without otherwise restricting a relative movement of the supports with respect to each other. Said transverse member effects a movement coupling of the upper portions of the backrest supports to each other. If one of the supports is tilted this leads automatically to a tilt movement coupled thereto of the other support. Thus, a pressure load on one side acting on the backrest causes a counter pressure on the other side of the backrest.

According to a further preferred embodiment said transverse member is formed as a rod with variable length for adjusting the spacing between the connection points at which the rod is connected by ball joints to the supports. The length of the transverse member can thus be set by the user for adaptation to the user's own body dimensions.

Hereinafter a preferred example of embodiment of the invention will be described in detail with the aid of the drawings.

DETAILED DESCRIPTION

Figure 1:
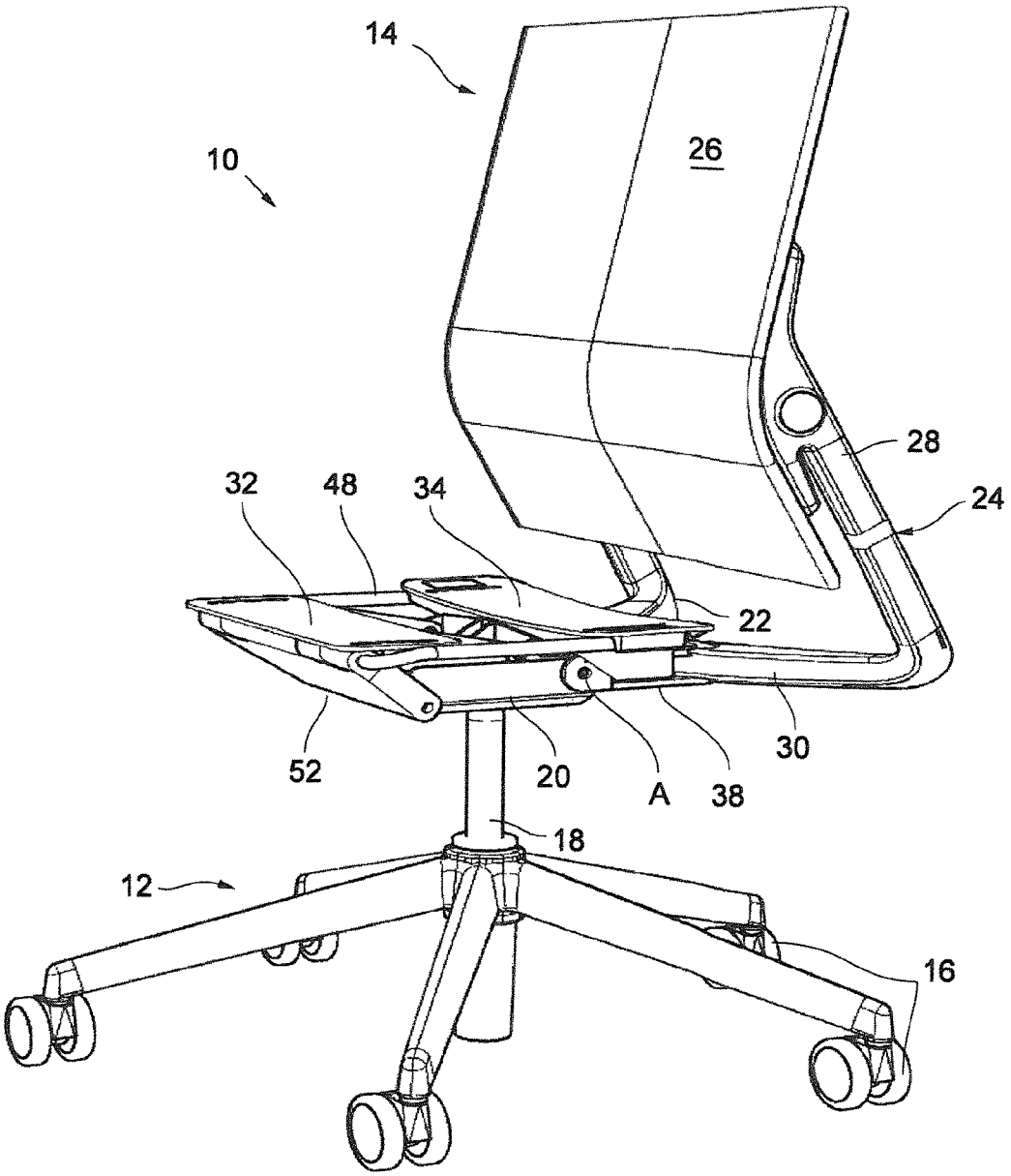
FIG. 1 is a perspective view of an office chair illustrating a preferred embodiment of the present invention.

The chair illustrated in FIGS. 1 to 7 is an office chair 10 which comprises in conventional manner an undercarriage 12 which bears a seat surface, and a backrest 14 which is mounted at the rear side of the chair 10. The terms "front" and "rear" as well as "lateral" are with reference to the usual position of use of the chair. The undercarriage 12 is provided in usual manner with a ring of rollers 16 which are mounted on arms extending from a vertically adjustable central column 18. The components of the undercarriage 12 are known and are not part of the present invention.

Figure 2:
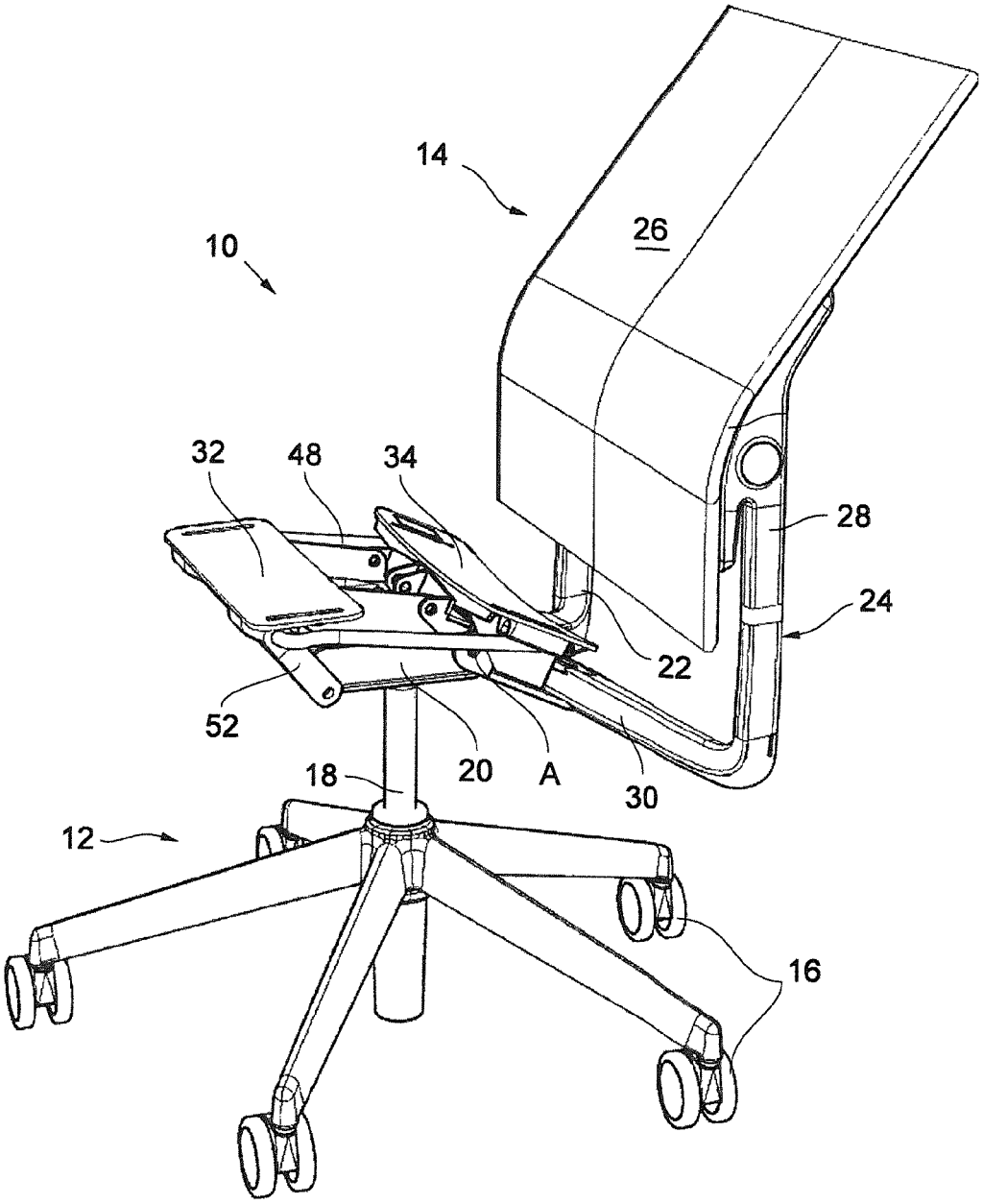
FIGS. 2 and 3 show the office chair or FIG. 1 in different positions.
Figure 3:
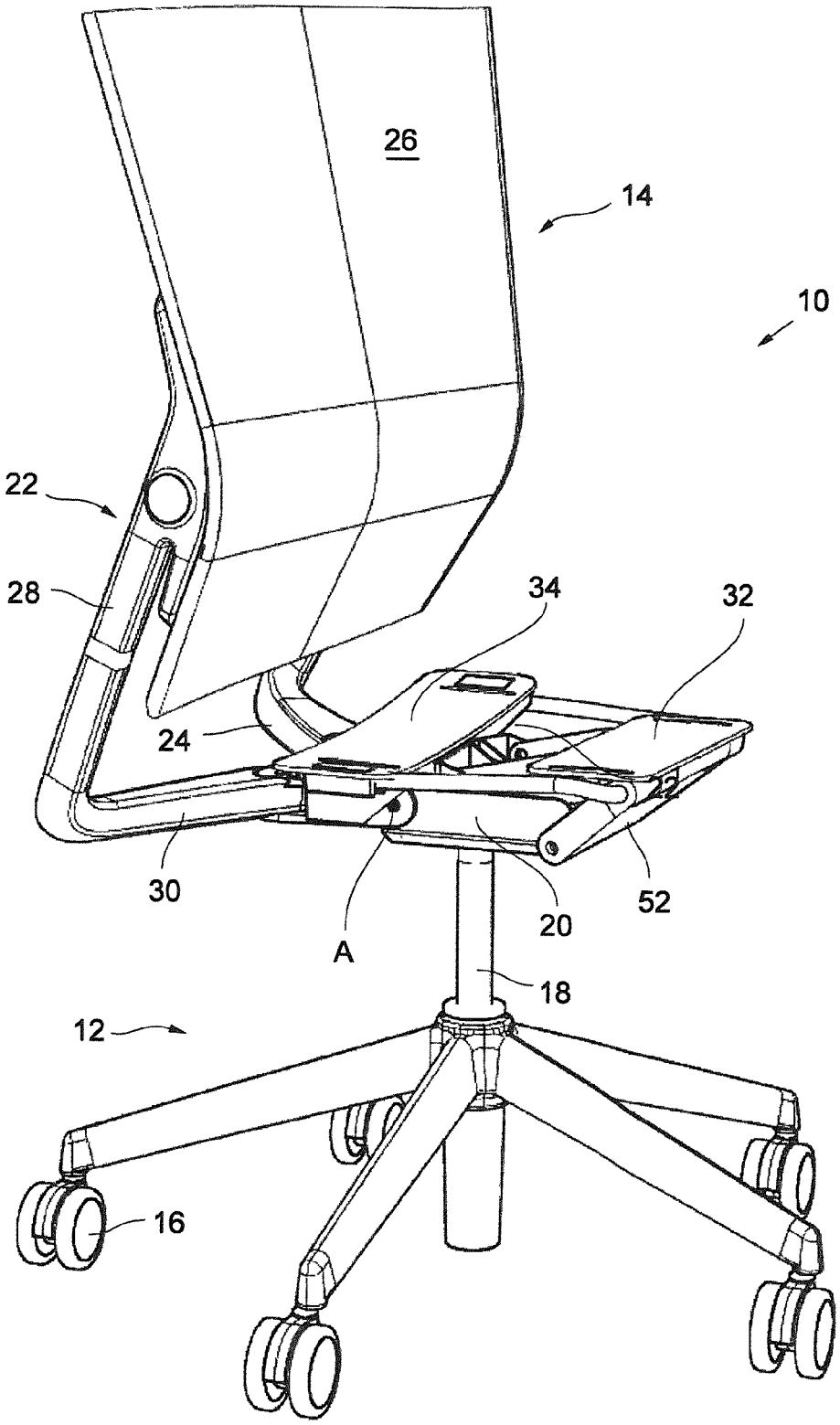
Figure 5:
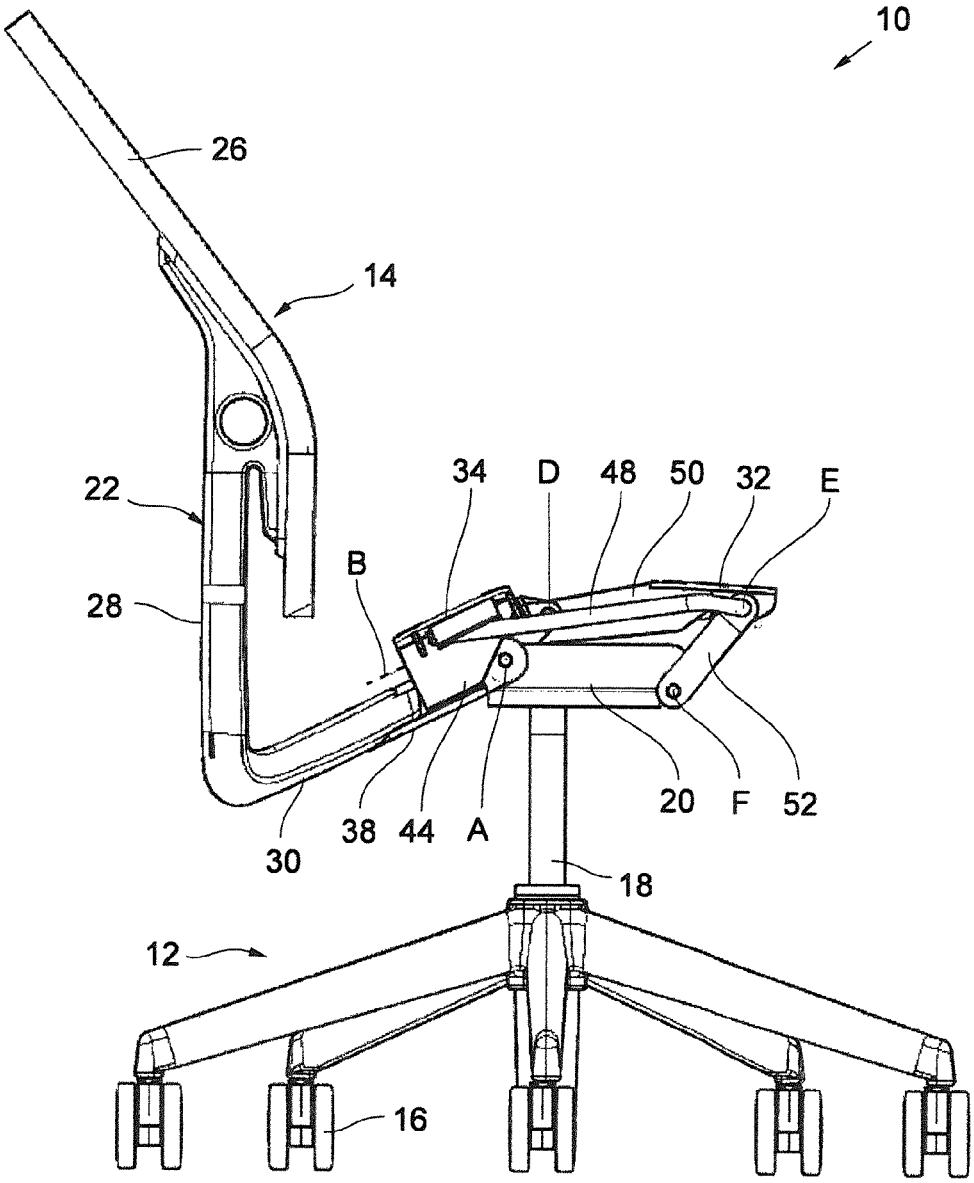
FIG. 5 shows the office chair in a side view on assuming a position corresponding to FIG. 2.
Figure 6:
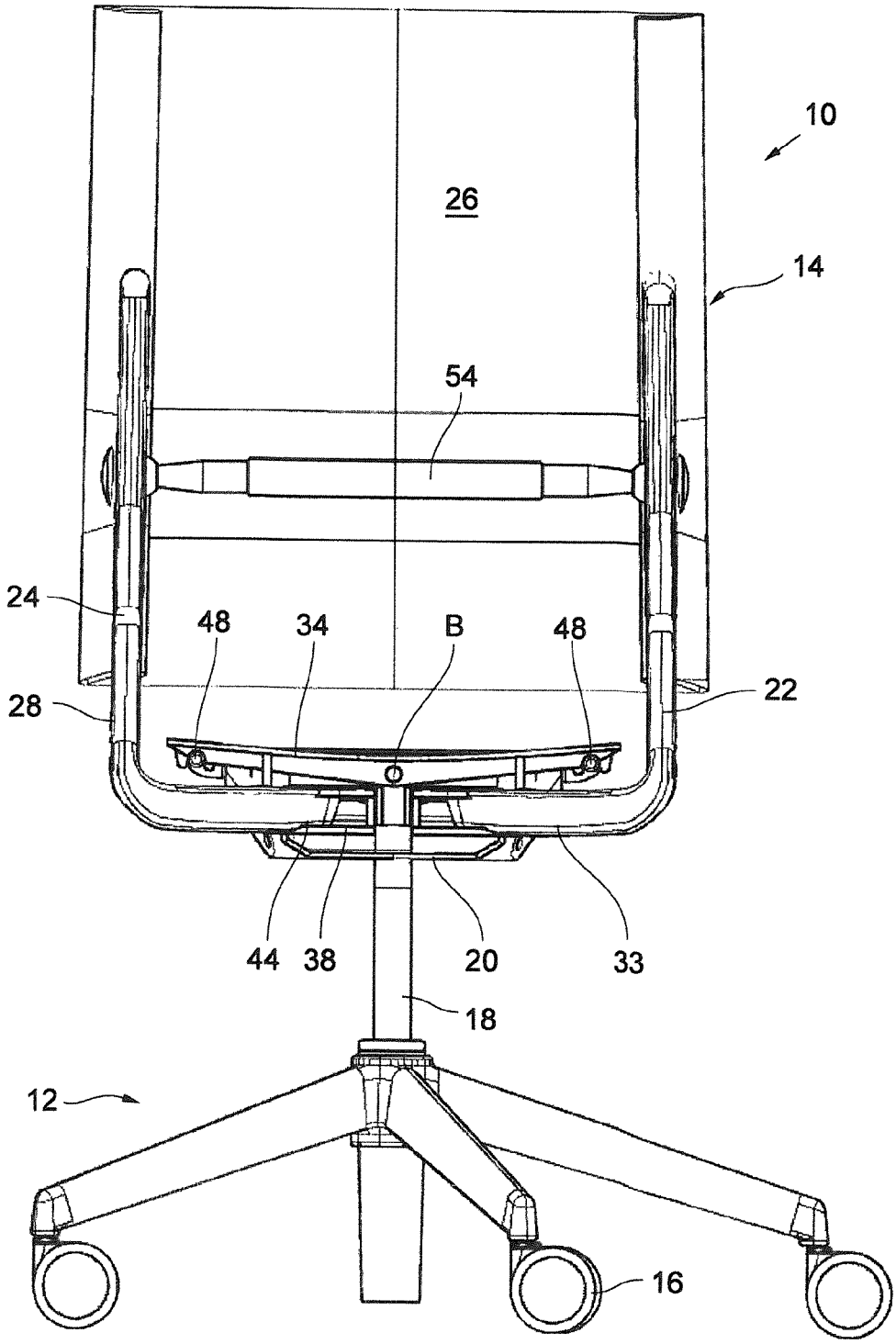
FIGS. 6, 7 and 8 are rear views of the office chair of the preceding Figures.
Figure 7:
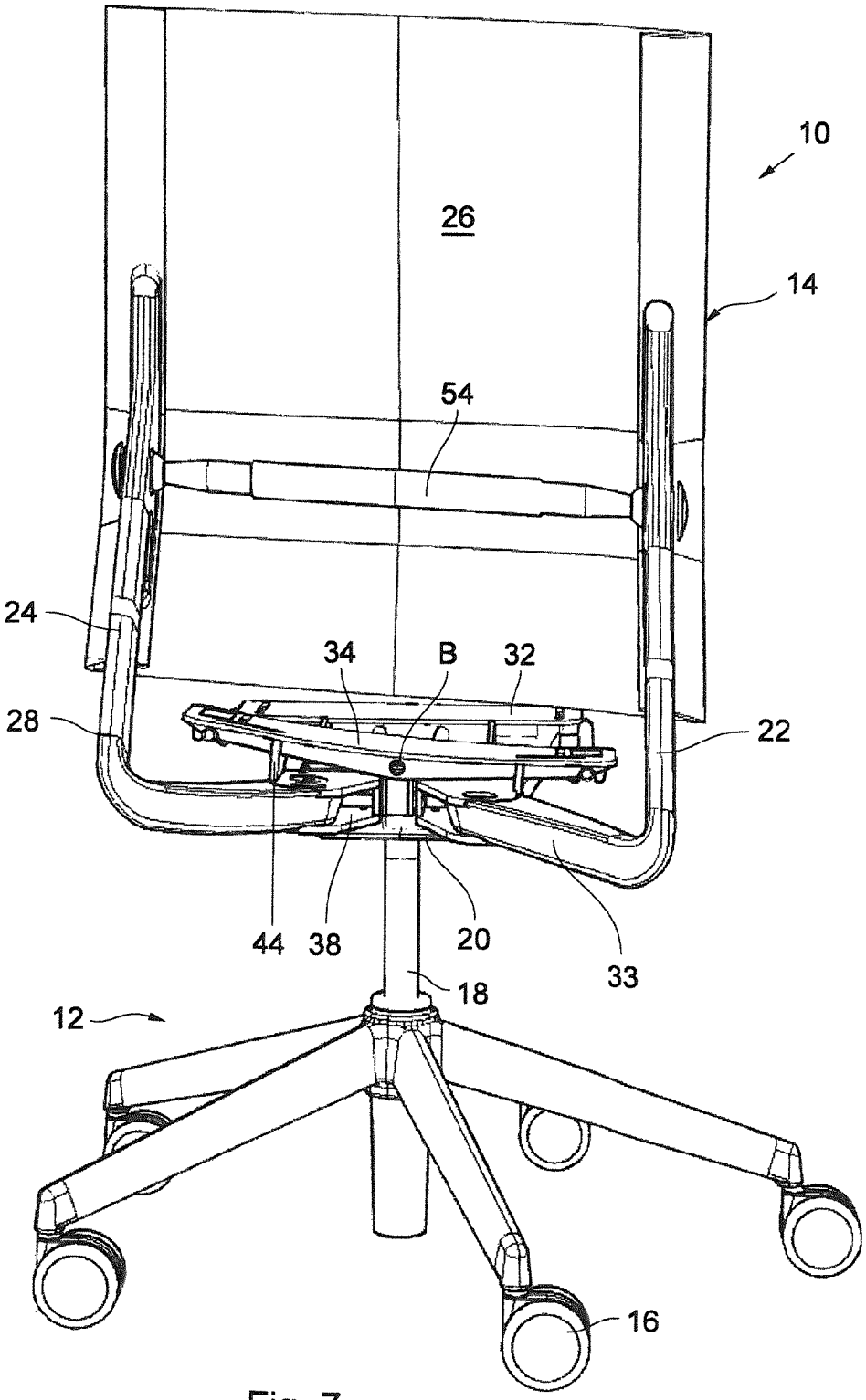

Mounted at the upper end of the central column 18 is a substantially plate-shaped base 20 of the undercarriage 12, said base being connected to further movable components of the chair 10. The backrest 14 is pivotally connected to the rear end of the base 20 so that the backrest 14 can be pivoted rearwardly with respect to the rear end of the base 20 as is illustrated in FIGS. 2 and 5. The pivot axis of the backrest 14 is designated in the drawings by the letter A. The axis A extends horizontally in the transverse direction of the chair 10.

The backrest 14 includes in detail two backrest supports 22, 24 which are connected by a common backrest surface 26. Said backrest area 26 has a certain elasticity which does not fundamentally impair the pivoting of the two backrest supports 22,24 on both sides of the chair 10 but merely somewhat limits the pivoting range. This does not impair the function according to the invention of the chair 10.

Figure 4:
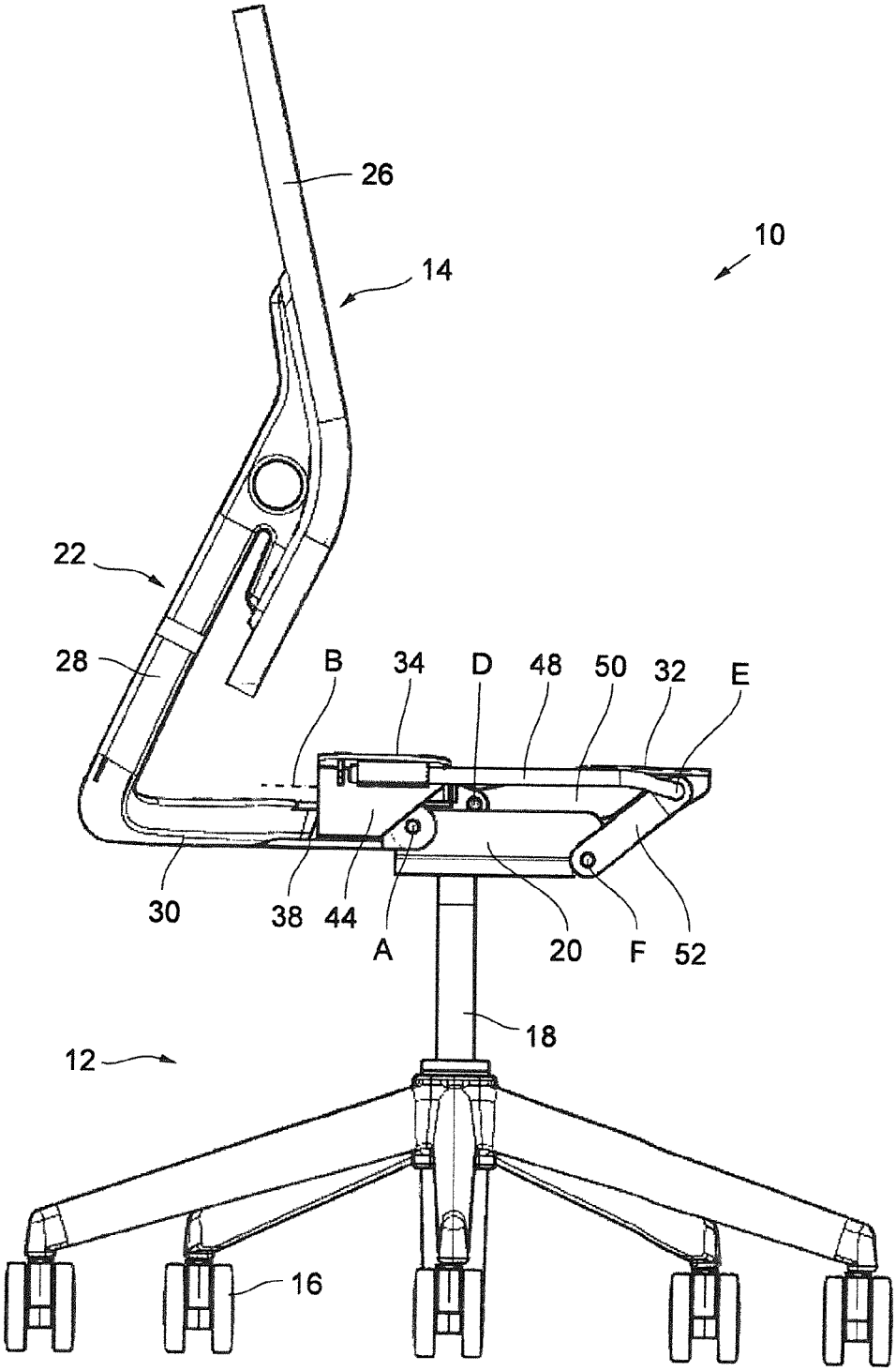
FIG. 4 is a side view of the office chair according to the present embodiment in a position corresponding to FIG. 1.

The backrest supports 22, 24 on both sides of the chair 10 are mounted on separate pivot bearings on the horizontal pivot axis A. Said pivot bearings are located at the rear side of the base 20 directly adjacent each other, as will be explained in more detail hereinafter, but on the common axis A. The supports 22, 24 can thus assume different angles of inclination. Each of the supports is formed substantially L-shaped and has a rear vertical leg 28 and a lower leg 30 which in FIGS. 1 and 4 is substantially horizontal and the front end of which leads to the respective pivot bearing. The length of the horizontal leg 30 provides a rearward offsetting of the backrest surface 26 with respect to the seat surface and the axis A and thus for an adequately comfortable sitting position. Moreover, it is obvious that the backrest area 26 can be cushioned or configured in any other desired manner to ensure adequate sitting comfort.

The seat area of the chair 10 is formed by two seat plates, that is a front seat plate 32 arranged at the front edge of the chair 10 and a rear seat plate 34 located between the front seat plate 32 and the backrest 14. Whereas the front seat plate 32 is substantially stationary, the rear seat plate 34 is movable to a great extent, as will be explained in detail hereinafter. It is disposed above the horizontal pivot axis A and bridges the entire width of the seat surface.

On a rearward inclination of the backrest 14 the rear seat plate 34 is tilted rearwardly and downwardly, as can be seen clearly in FIGS. 2 and 5. The seat plate 34 thus follows the movement of the backrest supports 22, 24 and is coupled in movement to the latter. Thus, like the backrest 14 the seat plate 34 is pivoted about the horizontal pivot axis A.

Figure 9:
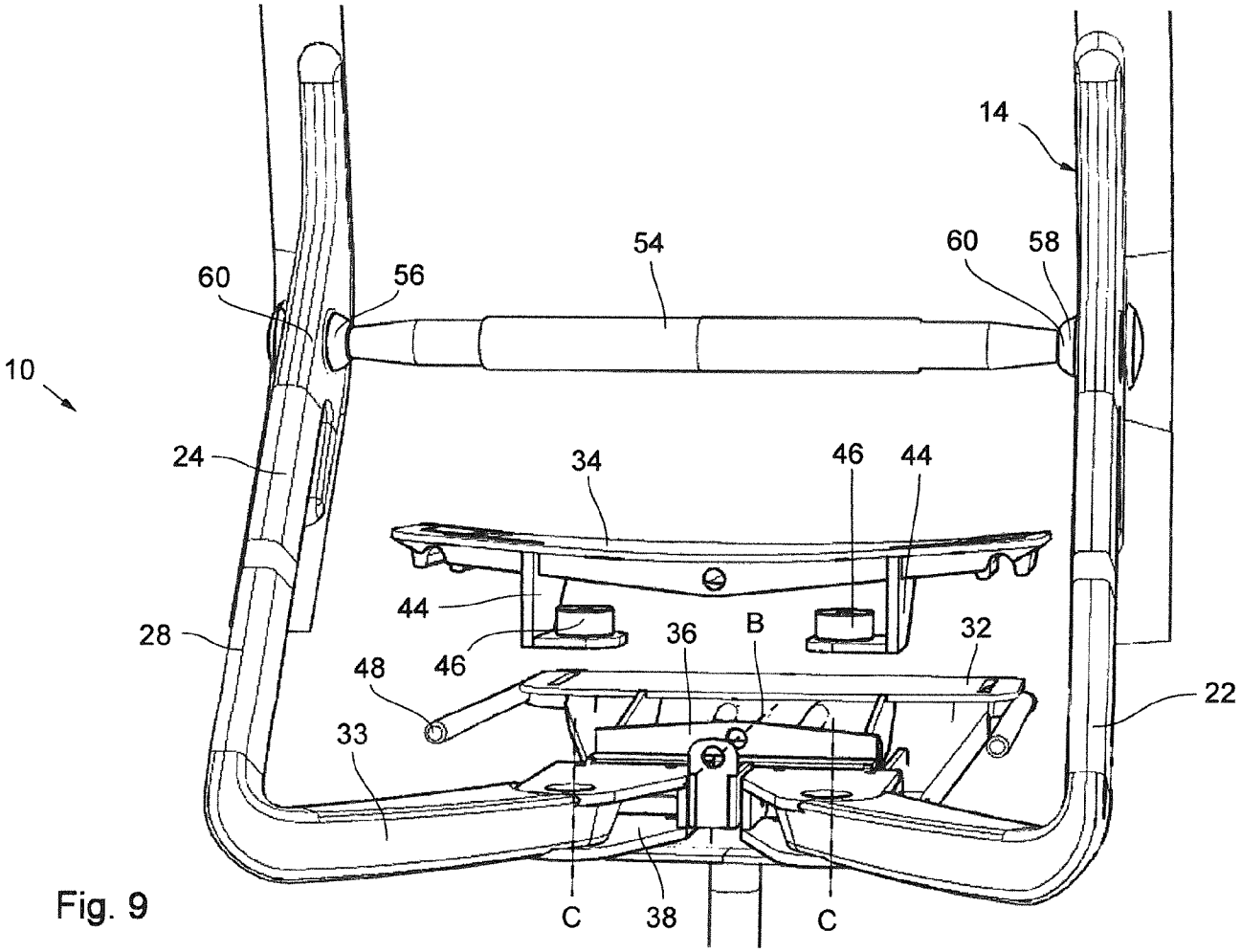
FIG. 9 is a detail view of the mechanism of the present preferred embodiment of the office chair according to the invention.
Figure 10:
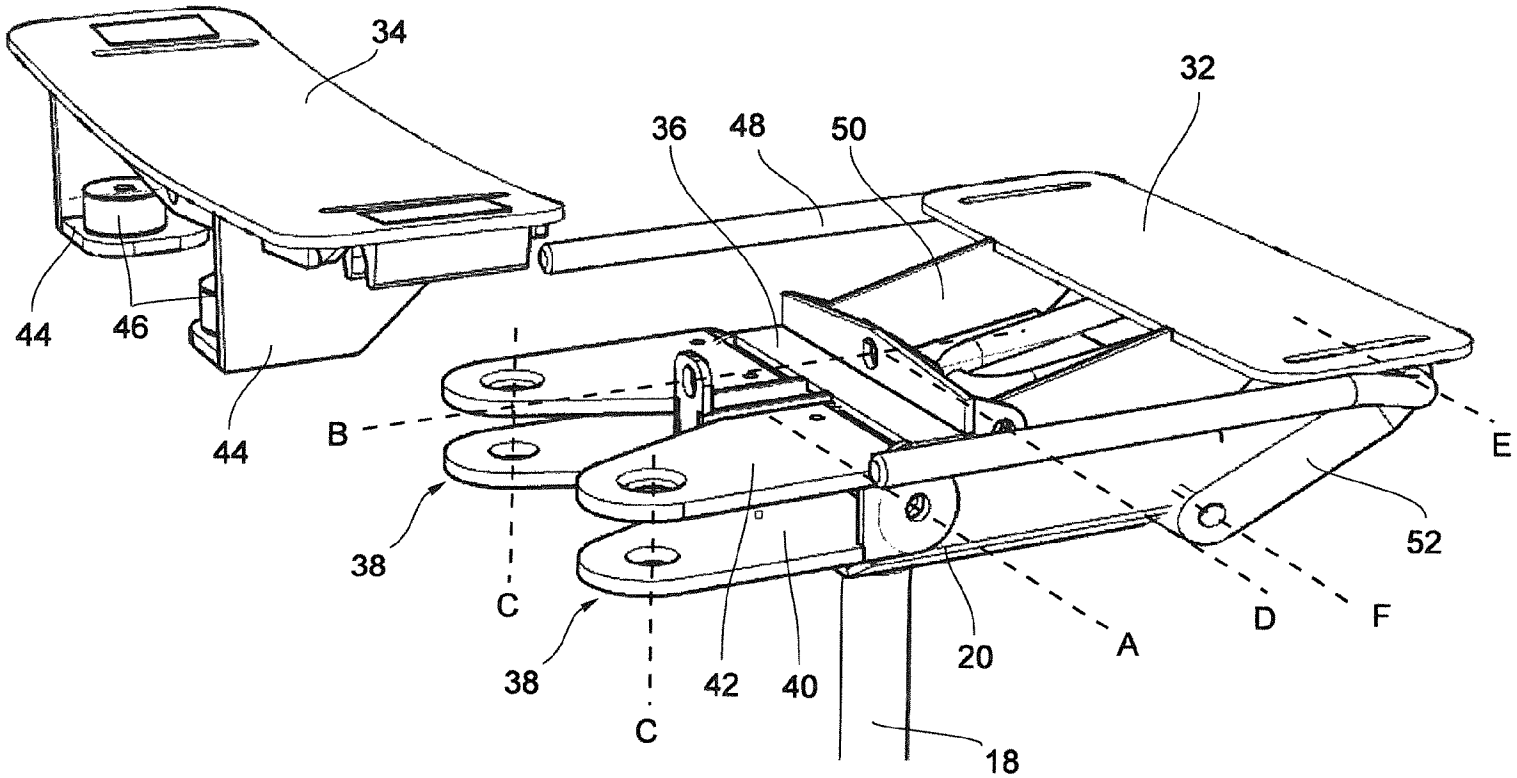
FIG. 10 is an exploded view of some of the mechanical components illustrated in FIG. 9.

The perspective rear view in FIG. 9 and the exploded illustration in FIG. 10 show how the seat plate 34 is coupled in movement to the backrest supports 22, 24. The seat plate 34 is mounted laterally tiltable, i.e. in the left-right direction, about a tilt axis B. The tilt axis B extends directly beneath the actual seat area and lies in a vertical symmetry plane of the chair 10 which in turn is perpendicular to the horizontal pivot axis A of the backrest 14. In the inoperative position of the chair in FIGS. 1, 4 and 7 the tilt axis B is horizontal.

The seat plate 34 is mounted tiltable about the axis B on a bearing member 36 which itself is tiltable about the pivot axis A. The seat plate 34 is therefore pivotal both about the horizontal axis A and about the tilt axis B, The tilt axis B is itself tilted out of the horizontal position when the bearing member 36 is pivoted about the pivot axis A.

The articulate connection between the backrest supports 22, 24 and the stationary part 20 of the undercarriage 12 is effected via front portions 38 of the forwardly angled legs 30 of the supports 22, 24. These front portions 38 are formed as pairs of plates 40, 42 (see FIG. 10) which are arranged parallel above each other and which enclose from above and below the forwardly directed ends of the remaining portions of the horizontal legs 30. As can be seen in particular in FIG. 7 the front portions 38 are articulately connected to the remaining portion of the respective support 22, 24, this being done via vertically disposed rotation axes C. In particular the vertical legs 28 of the supports 22, 24 are thus pivotally mounted at the rear side of the chair 10. The horizontal pivot axis A of the backrest 14 extends through the front ends of the portions 38.

Provided on both sides beneath the seat plate 34 are bearings 44 which are configured as members formed L-shaped at the underside of the seat plate 34. The horizontal legs of these members point towards each other and engage laterally into the portions 38 between the upper and lower plates 40 and 42. The upper plates 42 thus lie in the bearings 44, that is on pads 46 provided there for dampening.

Figure 8:
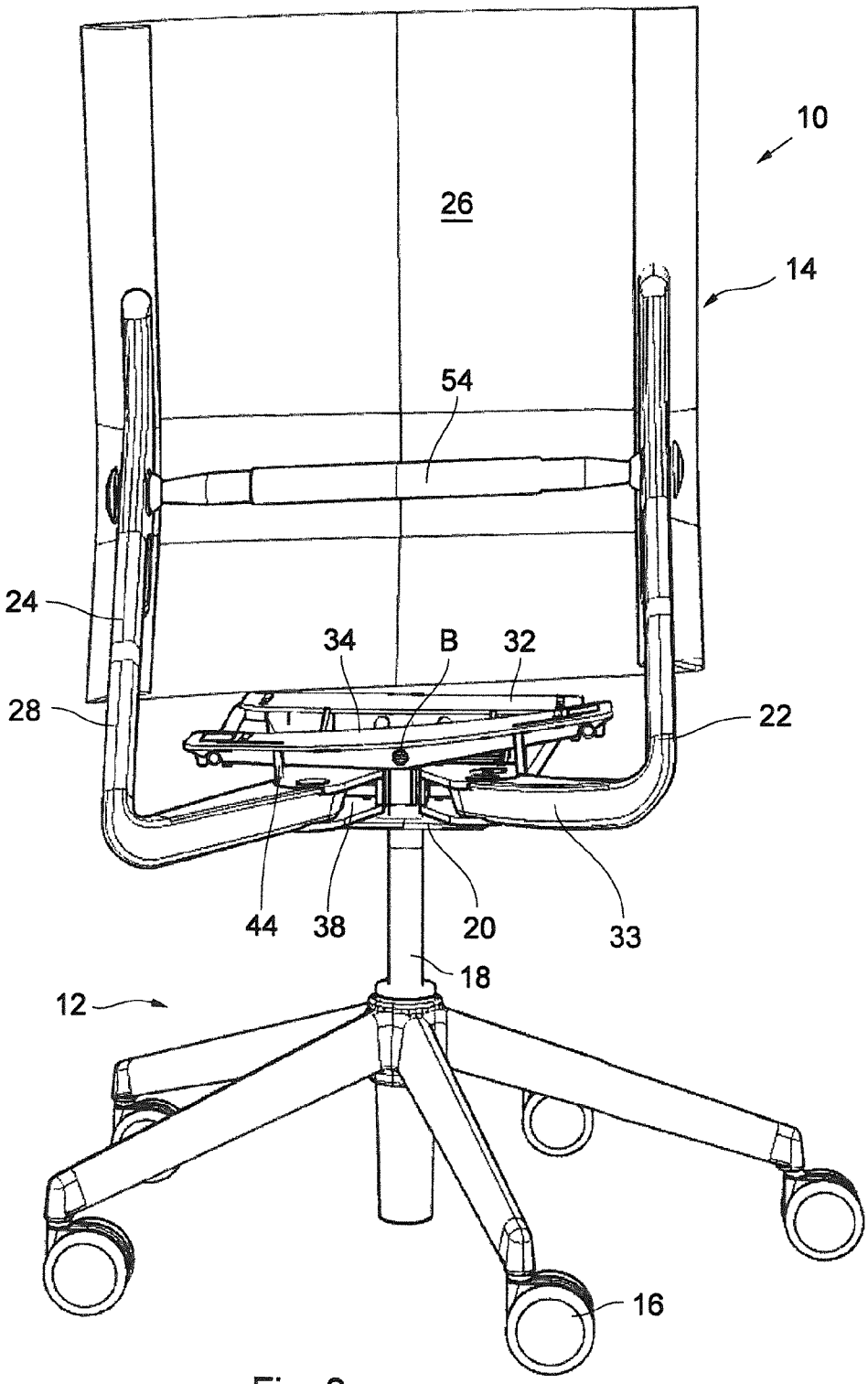

Since the portions 38 can be pivoted independently of each other about the axis A, on the two sides of the chair 10 a different pressure can be transmitted via the bearing means 44 to the seat plate 34 and this leads to the seat plate 34 being tilted laterally about the tilt axis B due to this one-sided load. If for example in accordance with FIGS. 3 and 7 the right backrest support 22 is pivoted rearwardly, its horizontal leg 30 will be pressed downwardly. When this happens, via the upper plate 42 the front portion 38 of the leg 30 exerts a pressure on the on the right bearing member 44 of the seat plate 34 so that said seat plate 34 is pressed down on this side whilst the opposite left side of the seat plate is raised. In other words the rearward pivoting of a support 22, 24 on one side of the chair 10 involves a pressing down of the rear seat plate 34 on the same side and a raising of the opposite end of the seat plate 34 on the other side. The backrest supports 22, 24 hereby assume different inclination positions. FIG. 8 shows the situation when a pressure is exerted on the left side of the seat plate 34.

The unilateral lowering of the seat plate takes place against the pressure of one end of a leg spring 48 which extends laterally rearwardly from the front seat plate 34 and on which the respective end of the rear seat plate 34 is mounted. Thus, the seat plate 34 on reduction of the pressure from above has the tendency to return to its horizontal position.

According to FIG. 10 a central part of the leg spring 48 is mounted in a front bearing member 50 which also carries the front seat plate 32 and is formed integrally with the latter. The rear end of said front bearing member 50 is connected pivotally about a horizontal pivot axis D to a front end of the bearing member 36 which carries the rear seat plate 34. At its front end the front bearing member 50 is articulately connected via a connector 52 to the front end of the base 20, lying therebelow, of the undercarriage 12. The articulation axis for connecting the front upper end of the connector 52 to the front bearing member 50 is denoted by the letter E whilst the articulation axis between the connector 52 and the base 20 is denoted by F. The axes A, D, E and F define a quadrilateral which approximately forms a parallelogram. This construction effects that on tilting of the bearing member 36 together with the rear seat plate 34 a tensile force is exerted on the front bearing member 50 with the front seat plate 32 and the latter is slightly raised, as becomes clear on comparison of FIGS. 4 and 5. The front seat plate however retains its horizontal position here.

Although the lower ends of the backrest supports 22, 24 are mounted independently of each other about the pivot axis A, in their upper region the supports 22,24 are coupled in movement; this is done according to FIGS. 6 to 9 by a transverse member 54 whose ends 56, 58 are articulately connected to the vertical legs 28 of the supports 22, 24 at about half the height of the backrest 14. This articulate connection is by ball joints 60. The transverse member 54 ensures that the distance between the connection points 56, 58 to the supports 22, 24 is kept constant without otherwise restricting the movement of the supports 22, 24 relative to each other. In particular, the pivoting of the supports 22, 24 in opposite directions remains possible. The transverse member 54 here assumes an inclined position and the vertical legs 28 of the supports 22, 24 can come closer to each other. This is made possible by a slight pivoting of the rear portions of the supports 22, 24 about the vertical pivot axes C with respect to the front portions 38.

In the movement sequence described above during the use of the chair 10 the distance between the articulation points of the transverse member 54 remains constant. However, the length of the transverse member 54 can be adjusted by the user employing a suitable mechanism so that the tension between the backrest supports 22, 24 is variable, This mechanism may for example include a spindle drive inside the transverse member 54.

The invention claimed is:

1. An office chair (10), comprising:

a seat plate (34) which is arranged on an undercarriage (12);

a backrest (14); and a synchronous mechanism permitting a synchronous movement of the seat plate (34) and the backrest (14), wherein the seat plate (34) is mounted laterally tiltable about a longitudinal tilt axis (B) that extends in a forward direction from the backrest, and the backrest includes two backrest supports (22, 24), the backrest supports having lower ends that are mounted pivotally independently of each other on the undercarriage (12) and are coupled in movement to the seat plate (34) in such a manner that by rearward pivoting of one of the supports (22, 24) a first side of the seat plate (34) is pressed down so as to be tilted about the tilt axis (B) to a position below the tilt axis (B) and a second side opposite the first side is raised to a position above the tilt axis (B), wherein a tilt shaft extends in a longitudinal direction along tilt axis (B) for the lateral tilting of the seat plate (34) and lies in a vertical plane between the backrest supports (22, 24).

2. The office chair according to claim 1, wherein the lower ends of the backrest supports (22, 24) are connected pivotally about a common horizontal pivot axis (A) to a base (20) of the undercarriage (12).

3. The office chair according to claim 2, wherein on the first side and the second side beneath the seat plate (34), a set of bearings (44) are provided in which the lower ends of the backrest supports (22, 24) lie in a region behind the pivot axis (A) thereof.

4. The office chair according to claim 3, wherein the seat plate (34) is pivotal together with the lower ends of the backrest supports (22, 24) about the pivot axis (A) thereof.

5. An office chair, comprising:

a seat plate (34) which is arranged on an undercarriage (12);

a backrest (14); and a synchronous mechanism permitting a synchronous movement of the seat plate (34) and the backrest (14), wherein the seat plate (34) is mounted laterally tiltable about a tilt axis (B) and the backrest includes two backrest supports (22, 24), the backrest supports having lower ends that are mounted pivotally independently of each other on the undercarriage (12) and are coupled in movement to the seat plate (34) in such a manner that by rearward pivoting of the support (22, 24) a first side of the seat plate (34) is pressed down so as to be tilted about the tilt axis (B) and a second side opposite the first side is raised, wherein the lower ends of the backrest supports (22, 24) are connected pivotally about a common horizontal pivot axis (A) to a base (20) of the undercarriage (12) and wherein a tilt shaft extends along tilt axis (B) for the lateral tilting of the of the seat plate (34) and lies in a vertical plane between the backrest supports (22, 24), wherein on the first side and the second side beneath the seat plate (34), a set of bearings (44) are provided in which the lower ends of the backrest supports (22, 24) lie in a region behind the pivot axis (A) thereof, wherein the seat plate (34) is pivotal together with the lower ends of the backrest supports (22, 24) about the pivot axis (A) thereof wherein in a rear region of the undercarriage (12) a bearing member (36) is mounted which is tiltable about the pivot axis (A) of the backrest supports (22, 24) and supports a tilt shaft aligned along the tilt axis (B) of the seat plate (34).

6. The office chair according to claim 5, wherein the seat plate (34) is arranged in a rear region of the seat surface and in a front region of the seat surface a front seat plate (32) is arranged, the front seat plate (32) having opposing sides, wherein a leg springs (48) extends rearwardly from each of said sides to support the rear seat plate (34) on both of the sides from below.

7. The office chair according to claim 6, wherein the front seat plate (32) is carried by a front bearing member (50), the front bearing member having a rear end that is articulately connected to a front end of the bearing member (36), the front bearing member having a front end that is articulately connected to the front end of the base (20) lying therebelow via a connection member (52) which in its rear end receives the horizontal pivot axis (A) of the supports (22, 24).

8. The office chair according to claim 1, wherein the lower ends of the backrest supports (22, 24) are formed by legs (30) angled forwardly in an L shape, the legs (30) having front portions (38) which are connected pivotally about substantially vertically directed axes (C) of rotation to the respective support (22, 24) and the legs (30) having front ends which accommodate the horizontal pivot axis (A) of the supports (22, 24).

9. An office chair, comprising:

a seat plate (34) which is arranged on an undercarriage (12);

a backrest (14); and a synchronous mechanism permitting a synchronous movement of the seat plate (34) and the backrest (14), wherein the seat plate (34) is mounted laterally tiltable and the backrest includes two backrest supports (22, 24), the backrest supports having lower ends that are mounted pivotally independently of each other on the undercarriage (12) and are coupled in movement to the seat plate (34) in such a manner that by rearward pivoting of the support (22, 24) a first side of the seat plate (34) is pressed down and a second side opposite the first side is raised, wherein the backrest supports (22, 24) are connected in an upper region by a transverse member (54), the transverse member having ends that are articulately connected to the backrest supports (22, 24), the ends forming connection points (56, 58) between the backrest supports (22, 24) and the transverse member, wherein a spacing is defined between the connection points (56, 58), the articulate connection of the transverse member to the backrest supports (22, 24) keeping the spacing between the connection points (56, 58) constant without otherwise restricting a relative movement of the backrest supports (22, 24) with respect to each other.

10. The office chair according to claim 9, wherein the transverse member (54) is formed as a rod with variable length for adjusting the spacing between the connection points (56, 58) at which the rod (54) is connected by ball joints (60) to the backrest supports (22,24).

* * * * *